US010816304B2

(12) United States Patent
McPherson et al.

(10) Patent No.: US 10,816,304 B2
(45) **Date of Patent: *Oct. 27, 2020**

(54) ARCHERY BOW RISER WITH STABILIZING DAMPER

(71) Applicant: MCP IP, LLC, Sparta, WI (US)

(72) Inventors: Mathew A. McPherson, Norwalk, WI (US); Jeffrey A. Ozanne, La Crosse, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/552,971

(22) Filed: Aug. 27, 2019

(65) Prior Publication Data

US 2019/0383576 A1 Dec. 19, 2019

Related U.S. Application Data

(63) Continuation of application No. 15/961,692, filed on Apr. 24, 2018, now Pat. No. 10,393,471.

(60) Provisional application No. 62/489,322, filed on Apr. 24, 2017.

(51) Int. Cl.

| | |
|---|---|
| ***F41B 5/20*** | (2006.01) |
| ***F41B 5/14*** | (2006.01) |
| ***F41B 5/10*** | (2006.01) |

(52) U.S. Cl.

CPC ..... *F41B 5/1426* (2013.01); *F41B 5/10* (2013.01)

(58) Field of Classification Search

CPC ..... F41B 5/1426

See application file for complete search history.

(56) References Cited

U.S. PATENT DOCUMENTS

| | | | |
|---|---|---|---|
| 5,803,070 | A | 9/1998 | Martin |
| 5,934,266 | A | 8/1999 | Martin |
| 6,257,220 | B1 | 7/2001 | McPherson |
| 6,382,201 | B1 | 5/2002 | McPherson |
| 6,543,432 | B2 | 4/2003 | Andrews |
| 6,550,467 | B2 | 4/2003 | Gallops, Jr. |
| 6,588,414 | B2 | 7/2003 | McMillan, III |
| 7,264,098 | B2 | 9/2007 | McPherson |
| 7,954,481 | B2 | 6/2011 | Barnard |
| 7,987,954 | B2 | 8/2011 | McPherson |
| 8,448,633 | B2 | 5/2013 | McPherson |
| 8,931,470 | B1 | 1/2015 | Khoshnood |
| 8,939,139 | B2 | 1/2015 | Sims |
| 9,032,947 | B2 | 5/2015 | Bidgare |
| 9,038,617 | B1 | 5/2015 | Khoshnood |
| 9,046,317 | B2 | 6/2015 | McPherson |
| 9,360,271 | B1 | 6/2016 | McPherson |
| 9,915,494 | B2 | 3/2018 | Potts |

(Continued)

OTHER PUBLICATIONS

2009 Mathews Inc Catalog.
2010 Mathews Inc Catalog.

*Primary Examiner* — John A Ricci

(57) ABSTRACT

In some embodiments, an archery bow comprises a riser comprising a grip location and a cavity. A first limb is supported by the riser and attached by a first limb fastener. A second limb is supported by the riser and attached by a second limb fastener. A bowstring extends between the limbs. A vibration damper is located in the cavity, the vibration damper comprising a resilient member and a weight. A first distance from the bowstring to the first limb fastener is less than a second distance from the bowstring to the vibration damper.

20 Claims, 8 Drawing Sheets

(56) References Cited

U.S. PATENT DOCUMENTS

| | | | |
|---|---|---|---|
| 10,393,471 | B2 | 8/2019 | McPherson et al. |
| 2002/0020403 | A1 | 2/2002 | Troubridge |

ARCHERY BOW RISER WITH STABILIZING DAMPER

CROSS-REFERENCE TO RELATED APPLICATIONS

This application claims the benefit and is a continuation of U.S. patent application Ser. No. 15/961,692, filed Apr. 24, 2018, which claims the benefit of U.S. Patent Application No. 62/489,322, filed Apr. 24, 2017, the entire contents of which are hereby incorporated herein by reference.

BACKGROUND OF THE INVENTION

This invention relates generally to archery bows and more specifically to archery bows having vibration dampers.

Archery bows are generally known in the art. Archery bows generate vibrations when shooting an arrow, and vibration dampers have been used in bows, for example as described in U.S. Pat. No. 6,382,201. A vibration damper will tend to increase the weight of a bow, so there is a trade-off between increased weight and decreased vibration and fatigue on a shooter. The vibration dampers on a bow handle tend to be aligned with the grip, such that the grip is vertically aligned with the vibration dampers.

Archery stabilizers are also known in the art, for example as shown in U.S. Pat. No. 5,273,022. Archery stabilizers are typically an accessory that can be attached to a bow riser. A stabilizer will increase the weight of the bow, so there is a trade-off between increased weight and additional stability.

There remains a need for novel archery bow designs that provide improvements in performance over known structures.

All US patents and applications and all other published documents mentioned anywhere in this application are incorporated herein by reference in their entireties.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a riser comprising a grip location and a vibration damper comprising a resilient member and a weight. A first limb is supported by the riser and attached by a first limb fastener, which engages a first threaded cavity. A second limb is supported by the riser and attached by a second limb fastener, which engages a second threaded cavity. A reference line extends through the first threaded cavity and the second threaded cavity. The grip location and the vibration damper are located on opposite sides of the reference line.

In some embodiments, an archery bow comprises a riser comprising a grip location and a vibration damper comprising a resilient member and a weight. The grip location defines a pivot axis. A first limb is supported by the riser and attached by a first limb fastener. A second limb is supported by the riser and attached by a second limb fastener. A reference line oriented parallel to the pivot axis intersects the vibration damper and the first limb fastener In some embodiments, an archery bow comprises a riser comprising a grip location and a cavity. A first limb is supported by the riser and attached by a first limb fastener. A second limb is supported by the riser and attached by a second limb fastener. A bowstring extends between the limbs. A vibration damper is located in the cavity, the vibration damper comprising a resilient member and a weight. A first distance from the bowstring to the first limb fastener is less than a second distance from the bowstring to the vibration damper.

In some embodiments, a riser comprises a housing defining a cavity for a vibration damper, and an outer surface of the housing comprises the distalmost structure of the riser.

In some embodiments, a riser comprises a housing defining a cavity for a vibration damper, and the riser defines an axis. An outer surface of the housing comprises the distalmost structure as measured perpendicular to the axis.

In some embodiments, an archery bow comprises a vibration damper comprising a resilient member and a suspended weight. The weight is asymmetrical and comprises a first side having a greater mass than a second side. In some embodiments, the first and second sides of an asymmetrical weight are located on opposite sides of a bowstring plane defined by the bow.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
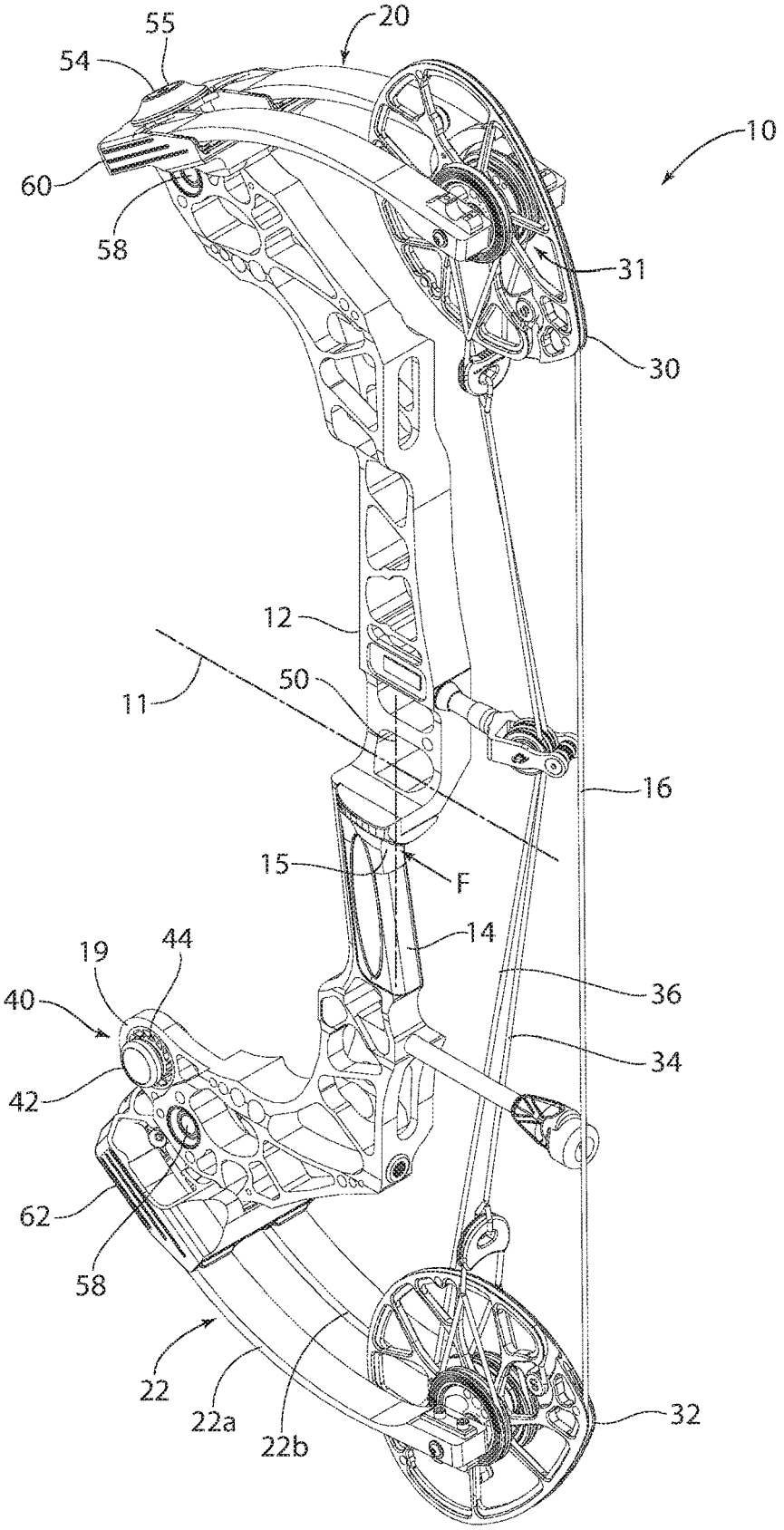
FIG. 1 shows an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
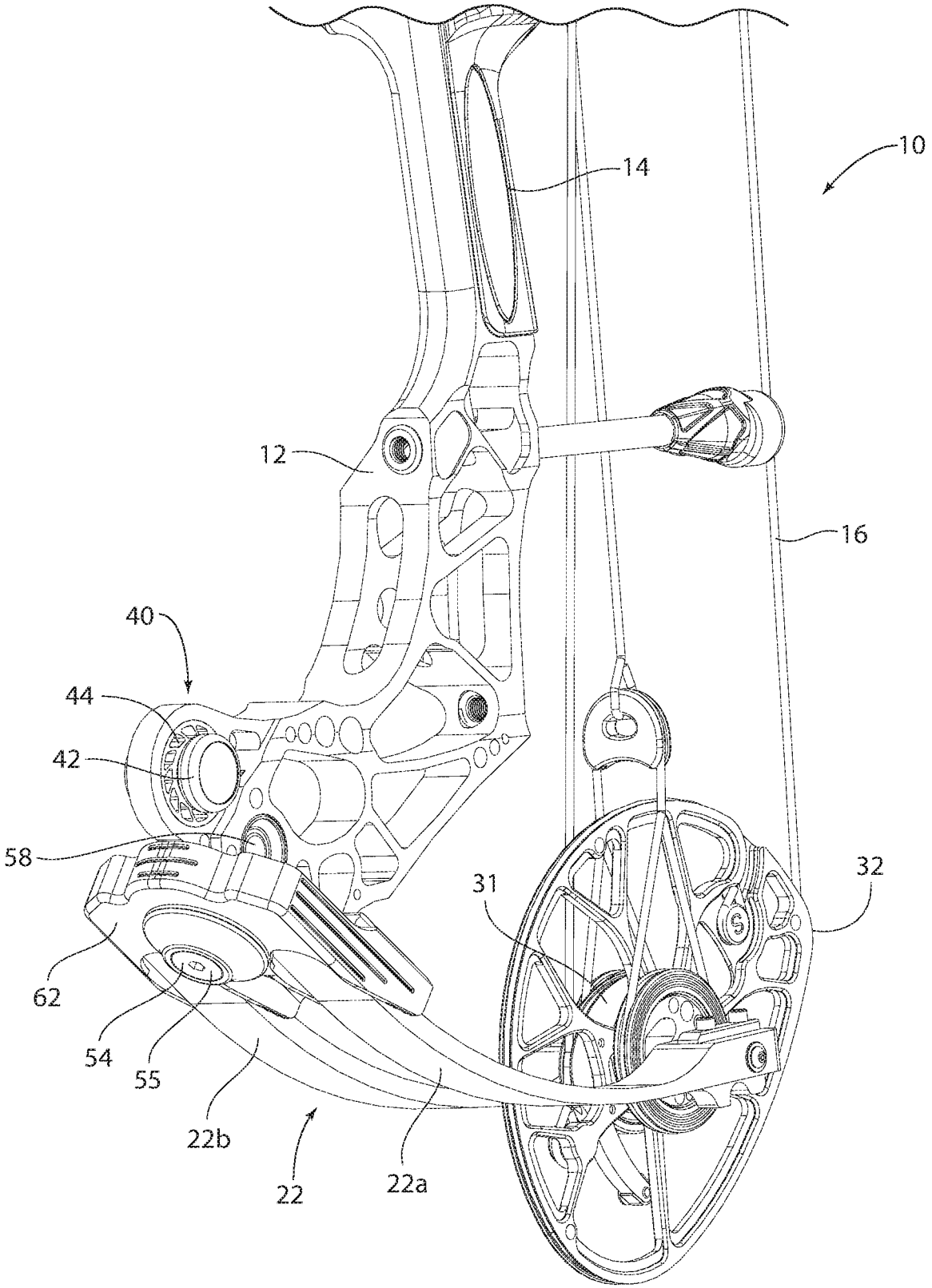
FIG. 2 shows another view of the bow of FIG. 1.

FIGS. 1 and 2 show different views of an embodiment of an archery bow 10. In some embodiments, a bow 10 comprises a riser 12, a grip 14, a first limb 20 and a second limb 22. Desirably, a bowstring 16 extends between the limbs 20, 22.

In some embodiments, the bow 10 comprises a compound bow comprising a power cable 34. In some embodiments, the first limb 20 supports a first rotatable member 30 and the second limb 22 supports a second rotatable member 32. In some embodiments, at least one of the rotatable members 30, 32 comprises a cam 31, and the cam 31 is arranged to take up the power cable 34 as the bow is drawn. In some embodiments, a bow 10 comprises a single cam bow. In some embodiments, a bow 10 comprises a 1.5 cam or cam-and-a-half bow. In some embodiments, a bow 10 comprises a two cam bow, and each rotatable member 30, 32 comprises a cam 31. In some embodiments, the power cable 34 comprises a first power cable, and the bow 10 further comprises a second power cable 36.

In some embodiments, the bow 10 comprises a vibration damper 40. In some embodiments, a vibration damper 40 comprises a weight 42 and a resilient member 44. In some embodiments, the weight 42 is supported by the resilient member 44 and comprises a mass that is suspended with respect to the riser 12. In some embodiments, deformation of the resilient member 44 allows the weight 42 to move with respect to the riser 12, for example in response to mechanical vibrations.

In some embodiments, the resilient member 44 contacts the riser 12. In some embodiments, the resilient member 44 is supported entirely by the riser 12. In some embodiments, the weight 42 is supported entirely by the resilient member 44. In some embodiments, the vibration damper 40 consists of the resilient member 44 and the weight 42.

In some embodiments, the damper 40 is located in a forwardmost portion of the riser 12. For example, if the bowstring 16 is spaced apart from the grip 14 in a rearward direction, the damper 40 can be spaced apart from the grip 14 in a forward direction. In some embodiments, the bow 10 defines a shooting axis 11, and the shooting axis 11 defines the forward and rearward directions.

When the bow 10 is held in a drawn orientation by a shooter, the shooter's hand generally contacts the grip 14 and places a force F on the grip 14. Although it is desirable to hold the bow 10 as steady as possible during aiming, archery bows are known to torque or pivot on the contact area 15 where force F is applied. For example, a bow 10 can pivot on a pivot axis 50 that extends through, or is proximate to, the contact area 15. In some embodiments, the pivot axis 50 is considered to extend parallel to the bowstring 16 when the bowstring 16 is in a brace/undrawn orientation (as shown in FIG. 1).

Placing the damper 40 at a location that is spaced apart from the pivot axis 50 increases the stability of the bow 10 about the pivot axis 50. The damper 40 location shown in FIG. 1 provides the bow 10 with the vibration damping characteristics of prior bows having vibration dampers, as well as stabilizing characteristics of prior bows having separately attached archery stabilizers, without adding the weight associated with an attached archery stabilizer.

In some embodiments, a limb 22 comprises a limb assembly comprising multiple limb members 22*a*, 22*b*, and the limb members 22*a*, 22*b* collectively support the associated rotatable member 32.

In some embodiments, the archery bow 10 comprises a first limb cup 60 and a second limb cup 62. Each limb cup 60, 62 can be attached to the riser 12 and can receive an associated limb 20, 22.

In some embodiments, a limb cup 60, 62 is attached to the riser 12 using a fastener 54. In some embodiments, the fastener 54 comprises a limb bolt 55. In some embodiments, a limb bolt 55 engages the riser 12 directly, for example being received in a threaded cavity formed directly in the riser 12. In some embodiments, a limb bolt 55 engages a limb nut 58, which can comprise a threaded cavity. As shown in FIGS. 1 and 2, the limb nut 58 comprises a barrel nut having a cylindrical outer shape. In some embodiments, the limb nut 58 is oriented in a cavity in the riser 12.

In some embodiments, the damper 40 is aligned with a limb cup 60. In some embodiments, the damper 40 is aligned with the limb nut 58. In some embodiments, the damper 40 is aligned with the fastener 54. In some embodiments, the damper 40 is oriented at a location spaced outward from the limb nut 58. In some embodiments, the damper 40 is oriented at a location spaced outward from the fastener 54. In some embodiments, the damper 40 is oriented at a location spaced outward from the limb cup 62.

Figure 3:
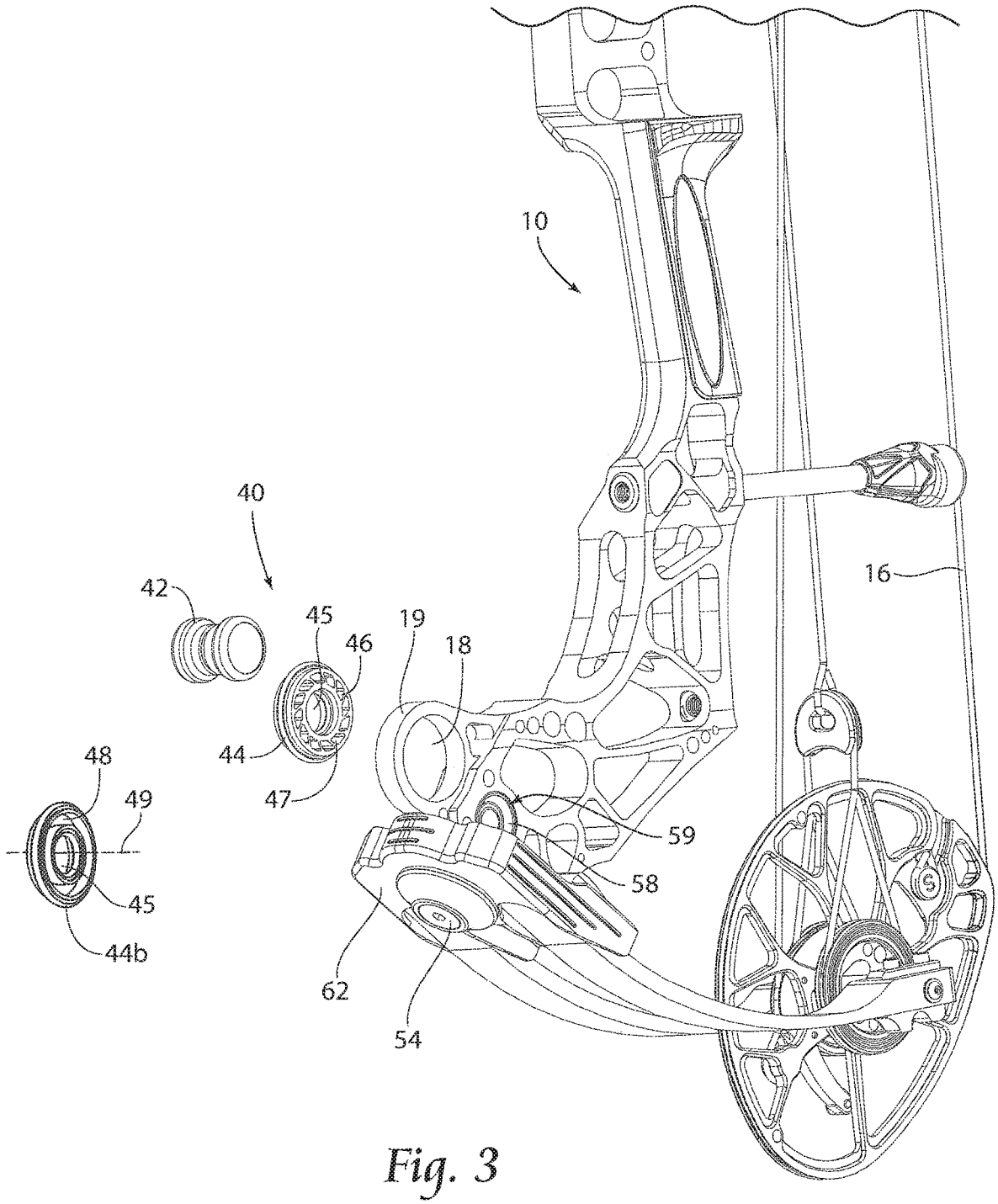
FIG. 3 shows the bow of FIG. 2 with components from an embodiment of a vibration damper exploded.

FIG. 3 shows the bow 10 of FIG. 2 with the damper 40 removed from the riser 12. In various embodiments, the weight 42 can have any suitable size, shape and mass, and can be made from any suitable material. In some embodiments, the weight 42 comprises a metal. The resilient member 44 can also have any suitable size and shape, and be made from any suitable material. Desirably, the resilient member 44 deforms and allows the weight 42 to temporarily move with respect to the riser 12. In some embodiments, the resilient member 44 comprises rubber or an elastomeric material. In some embodiments, the resilient member 44 consists of an elastomeric material. Some examples of weights 42 and resilient members are shown in U.S. Pat. No. 6,382,201, the entire disclosure of which is hereby incorporated herein by reference.

In some embodiments, the resilient member 44 comprises a central aperture 45 suitable for engaging and retaining the weight 42. In some embodiments, the resilient member 44 comprises a plurality of spokes 47 separated by secondary apertures 46.

FIG. 3 shows an alternative embodiment of a resilient member 44*b*. In some embodiments, a resilient member 44*b* comprises a channel 48 that extends around the central aperture 45. In some embodiments, the channel 48 comprises a c-shaped cross-section. The alternative resilient member 44*b* can allow a greater degree of lateral movement for the weight 42 (e.g. movement in a direction along a central axis 49 of the central aperture 45.

In some embodiments, the riser 12 comprises an aperture 18 arranged to receive the resilient member 44. In some embodiments, the riser 12 comprises a housing structure 19 that defines the aperture 18. In some embodiments, the housing structure 19 is integrally formed with the riser 12. In some embodiments, the housing structure 19 comprises the forwardmost portion of the riser 12, for example being the portion of the riser 12 spaced farthest from the bowstring 16 in the brace condition. In some embodiments, an outer surface of the housing structure 19 comprises the portion of the riser 12 located farthest away from the pivot axis 50.

In some embodiments, the riser 12 comprises a single piece of material, and the single piece of material comprises the housing structure 19 and defines the aperture 18. In some embodiments, the single piece of material also comprises an aperture 59 for limb attachment hardware. In some embodiments, the aperture 59 is arranged to receive a limb nut 58. In some embodiments, the aperture 59 comprises a threaded cavity or hole arranged to engage a limb fastener 54.

In some embodiments, the housing structure 19 is narrower than an adjacent portion of the riser 12. For example, a portion of the riser 12 that comprises a threaded cavity comprises a first width, and the housing structure 19 comprises a second width less than the first width. In some embodiments, a limb nut 58 comprises a width dimension, and the housing structure 19 comprises a second width less than the width of the nut 58. In some embodiments, the riser 12 comprises an aperture for the limb nut 58, the riser 12 defining a first width at the aperture, and the housing structure 19 comprises a second width less than the first width.

Figure 4:
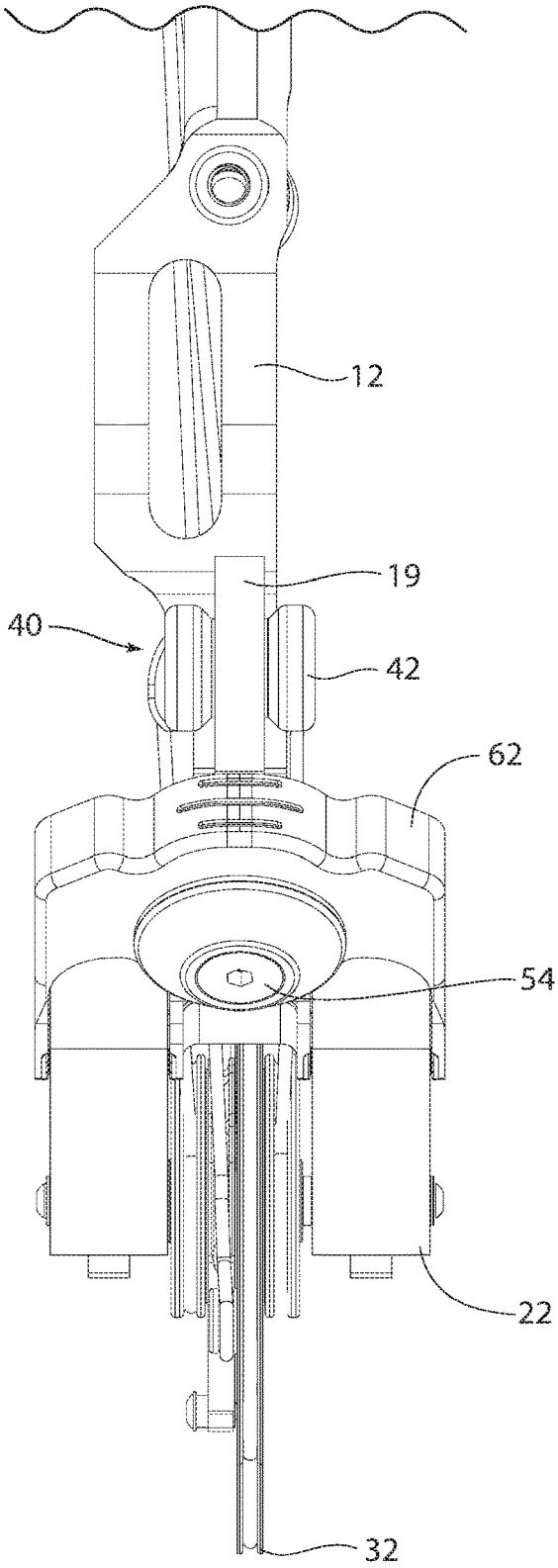
FIG. 4 shows another embodiment of a bow.

FIG. 4 shows another view of an embodiment of a bow 10 and a damper 40.

Figure 5:
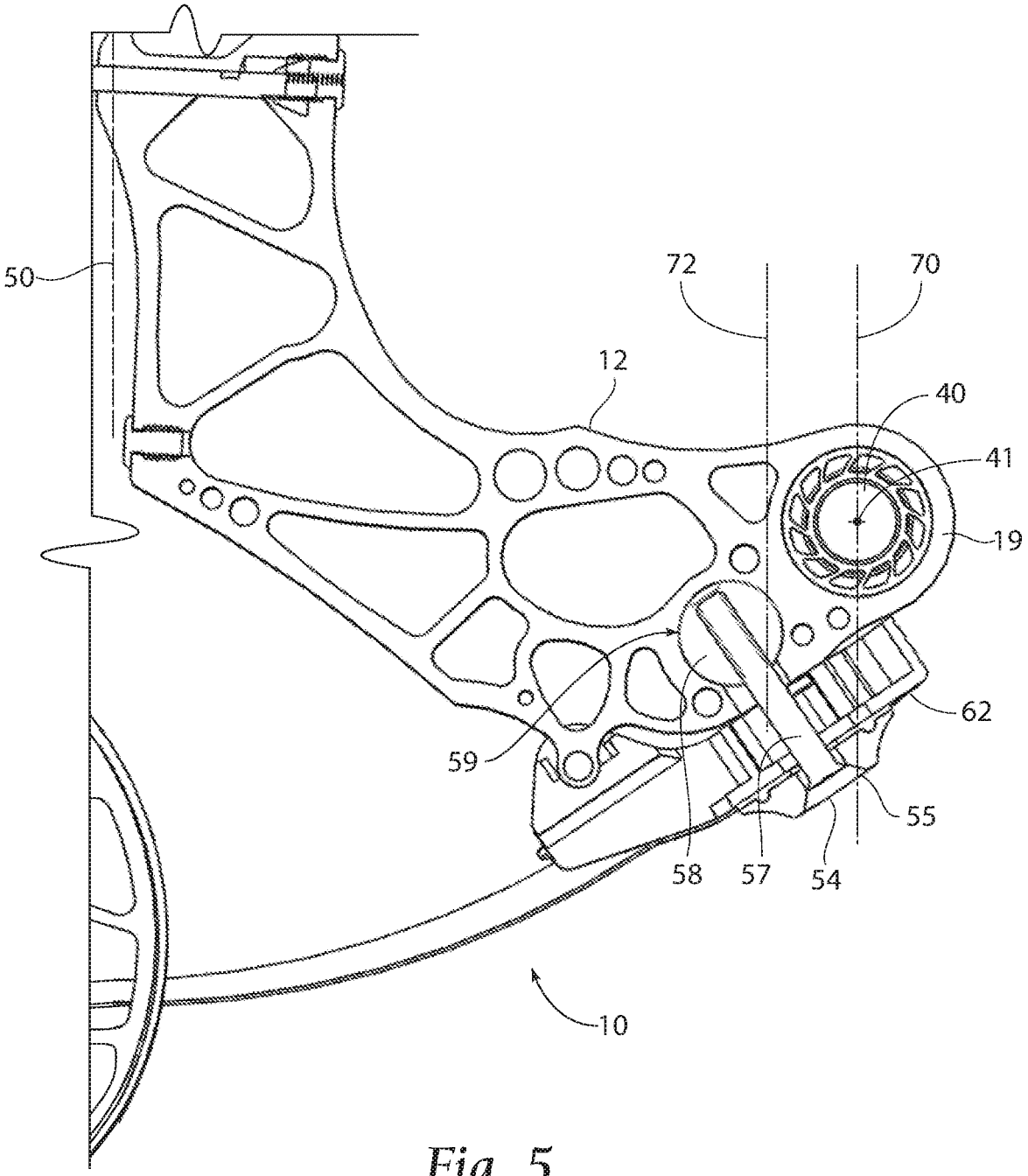
FIG. 5 shows a sectional drawing of an embodiment of a bow.

FIG. 5 shows a cross-sectional view of an embodiment of a bow 10, which shows the limb attachment components in greater detail.

In some embodiments, a fastener 54 comprises a shaft 57 and a head 55. In some embodiments, the shaft 57 comprises threads that engage threads in the riser 12, or engage threads of a nut 58. In some embodiments, a nut 58 comprises a cylindrical outer surface, and the nut 58 is received in an aperture 59 in the riser 12. In some embodiments, a nut 58 having a cylindrical outer surface allows the nut 50 to pivot with respect to the riser 12, for example as the fastener 54 is tightened and the limb take-off angle changes.

Figure 6:
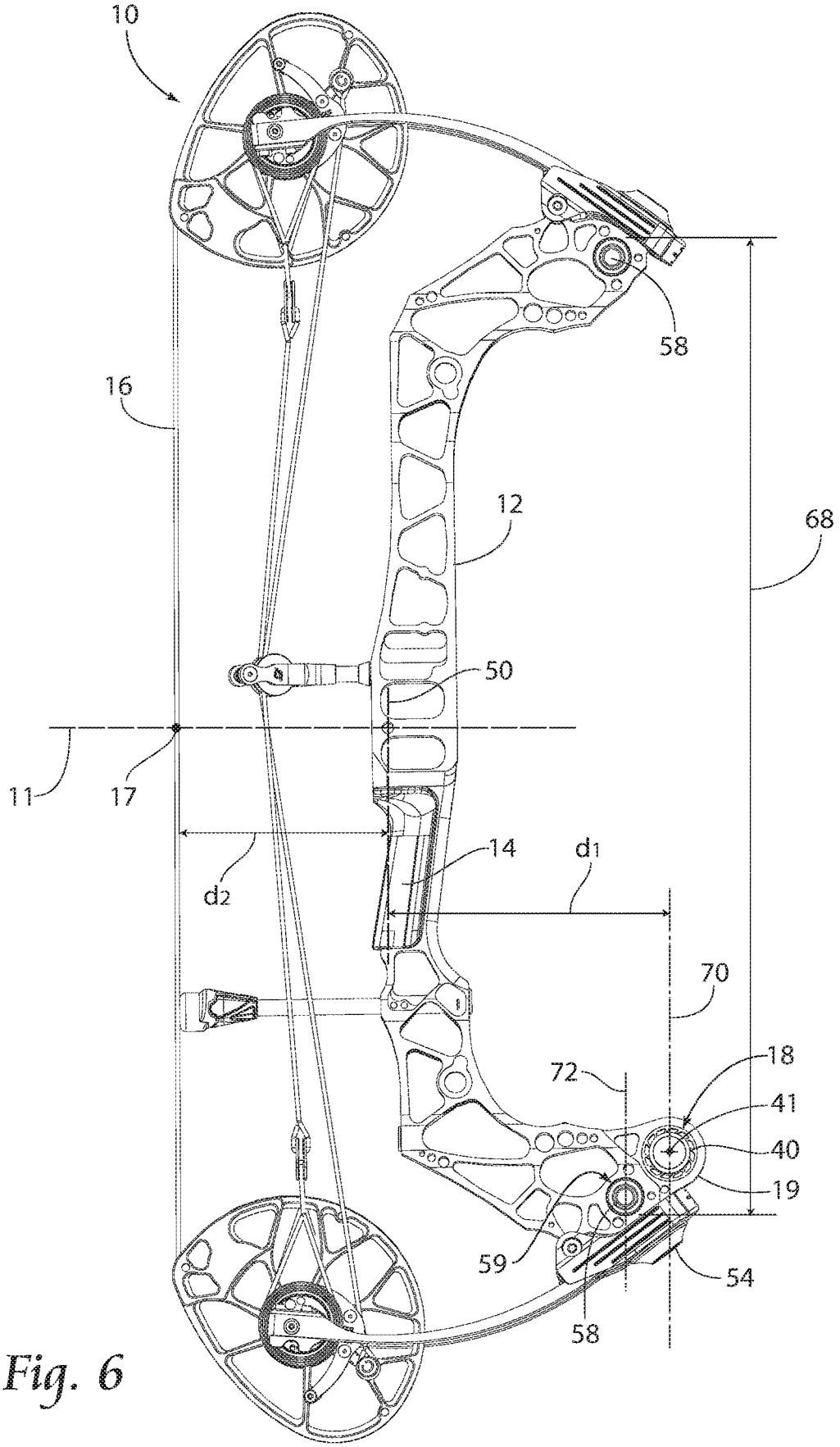
FIG. 6 shows another view of an embodiment of a bow.

FIG. 6 shows a side view of an embodiment of an archery bow 10. Desirably, the bow 10 defines a shooting axis 11. In some embodiments, the bowstring 16 comprises a nocking point 17, and the nocking point 17 moves along the shooting axis 11 as the bow 10 is drawn.

In some embodiments, the pivot axis 50 is oriented orthogonal to the shooting axis 11.

Referring to FIGS. 5 and 6, in some embodiments, a vibration damper 40 is attached to a forward portion of the riser 12, for example being spaced away from an archer and the bowstring 16. In some embodiments, the vibration damper 40 is spaced away from the grip 14. In some embodiments, the vibration damper 40 is aligned with limb fasteners 54, 58. In some embodiments, the vibration damper 40 is positioned outboard of the limb fasteners 54, 58. In some embodiments, the vibration damper 40 is aligned with a limb cup 62. In some embodiments, the vibration damper 40 is positioned outboard of the limb cup 62.

In some embodiments, a reference line 70 will contact the vibration damper 40 and the limb cup 62. In some embodiments, the reference line 70 will contact the vibration damper 40 and the limb fastener 54.

In some embodiments, the reference line 70 is oriented parallel to the pivot axis 50. In some embodiments, the reference line 70 is oriented parallel to the bowstring 16 in the brace condition. In some embodiments, the reference line 70 is oriented orthogonal to the shooting axis 11. In some embodiments, the reference line 70 passes through a centroid 41 of the vibration damper 40.

In some embodiments, the bow 10 defines a first distance $d_1$ between the pivot axis 50 and a reference line 70 that passes through the centroid 41 of the vibration damper 40. In some embodiments, the first distance $d_1$ is measured in a direction parallel to the shooting axis 11. In some embodiments, the bow 10 defines a second distance $d_2$ between the pivot axis 50 and the bowstring 16 in the brace condition. Desirably, the second distance $d_2$ is measured in a direction parallel to the first distance $d_1$. In some embodiments, the first distance $d_1$ is greater than the second distance dz.

In some embodiments, a reference line 72 oriented orthogonal to the shooting axis 11 will intersect a limb fastener 54, and the reference line 72 does not intersect the vibration damper 40. In some embodiments, the reference line 72 intersects the aperture 59 that is arranged to receive limb attachment hardware (e.g. a limb nut 58 or a limb fastener 54.

In some embodiments, a limb nut 58 comprises a threaded cavity, and the limb nut 58 engages the limb fastener 54. In some embodiments, the reference line 72 will intersect a limb nut 58, and the reference line 72 does not intersect the vibration damper 40. In some embodiments, the vibration damper 40 is located outboard of the reference line 72. In some embodiments, the reference line 72 is located between the vibration damper 40 and the pivot axis 50.

In some embodiments, a reference line 72 that intersects threaded cavities or limb nuts 58 is oriented between the pivot axis 50 and a reference line 70 that passes through the centroid 41 of the vibration damper 40.

In some embodiments, a distance between the bowstring 16 and a limb aperture 59 is less than a distance between the bowstring 16 and the damper aperture 18. In some embodiments, the distances are measured parallel to the shooting axis 11. In some embodiments, a distance between the bowstring 16 and a limb nut 58 is less than a distance between the bowstring 16 and the vibration damper 40. In some embodiments, a distance between the bowstring 16 and a limb fastener 54 is less than a distance between the bowstring 16 and the vibration damper 40.

In some embodiments, a distance between the pivot axis 50 and a limb aperture 59 is less than a distance between the pivot axis 50 and the damper aperture 18. In some embodiments, the distances are measured parallel to the shooting axis 11. In some embodiments, a distance between the pivot axis 50 and a limb nut 58 is less than a distance between the pivot axis 50 and the vibration damper 40. In some embodiments, a distance between the pivot axis 50 and a limb fastener 54 is less than a distance between the pivot axis 50 and the vibration damper 40.

In some embodiments, the bow 10 defines an axle-to-axle dimension, and the distance $d_1$ between the pivot axis 50 and the reference axis 70 is at least 15% of the axle-to-axle dimension. For example, in some embodiments, an axle-to-axle dimension is 28 inches, and the distance $d_1$ is 4.2 inches or more. In some embodiments, the distance $d_1$ is at least 20% of the axle-to-axle dimension. In some embodiments, the distance $d_1$ is at least 25% of the axle-to-axle dimension.

In some embodiments, the riser 12 defines threaded cavities for attaching limb fasteners 54. In some embodiments, threaded cavities are formed directly in the riser 12. In some embodiments, limb nuts 58 comprise the threaded cavities. In some embodiments, the riser 12 defines a distance 68 between the threaded cavities, and the distance $d_1$ between the pivot axis 50 and the reference axis 70 is at least 20% of the distance 68 between threaded cavities. In some embodiments, a greatest distance between threaded cavities is 23 inches, and the distance $d_1$ is 4.6 inches or more. In some embodiments, the distance $d_1$ is at least 25% of the distance 68. In some embodiments, the distance $d_1$ is at least 30% of the distance 68.

In some embodiments, a riser 12 comprises a housing 19 defining a cavity 18 for a vibration damper 40. In some embodiments, the riser 12 defines a first axis and a second axis, wherein the first axis is orthogonal to the second axis. In some embodiments, the first axis comprises the shooting axis 11 and the second axis comprises the pivot axis 50. In some embodiments, the first axis and second axis pass through the center of gravity of the riser 12, and the first axis comprises an x-axis and the second axis comprises a y-axis. In some embodiments, the first axis is horizontal and the second axis is vertical when the riser 12 is in a typical shooting orientation. In some embodiments, an outer surface of the housing 19 comprises the distalmost structure of the riser 12 from the second axis as measured parallel to the first axis.

Figure 7:
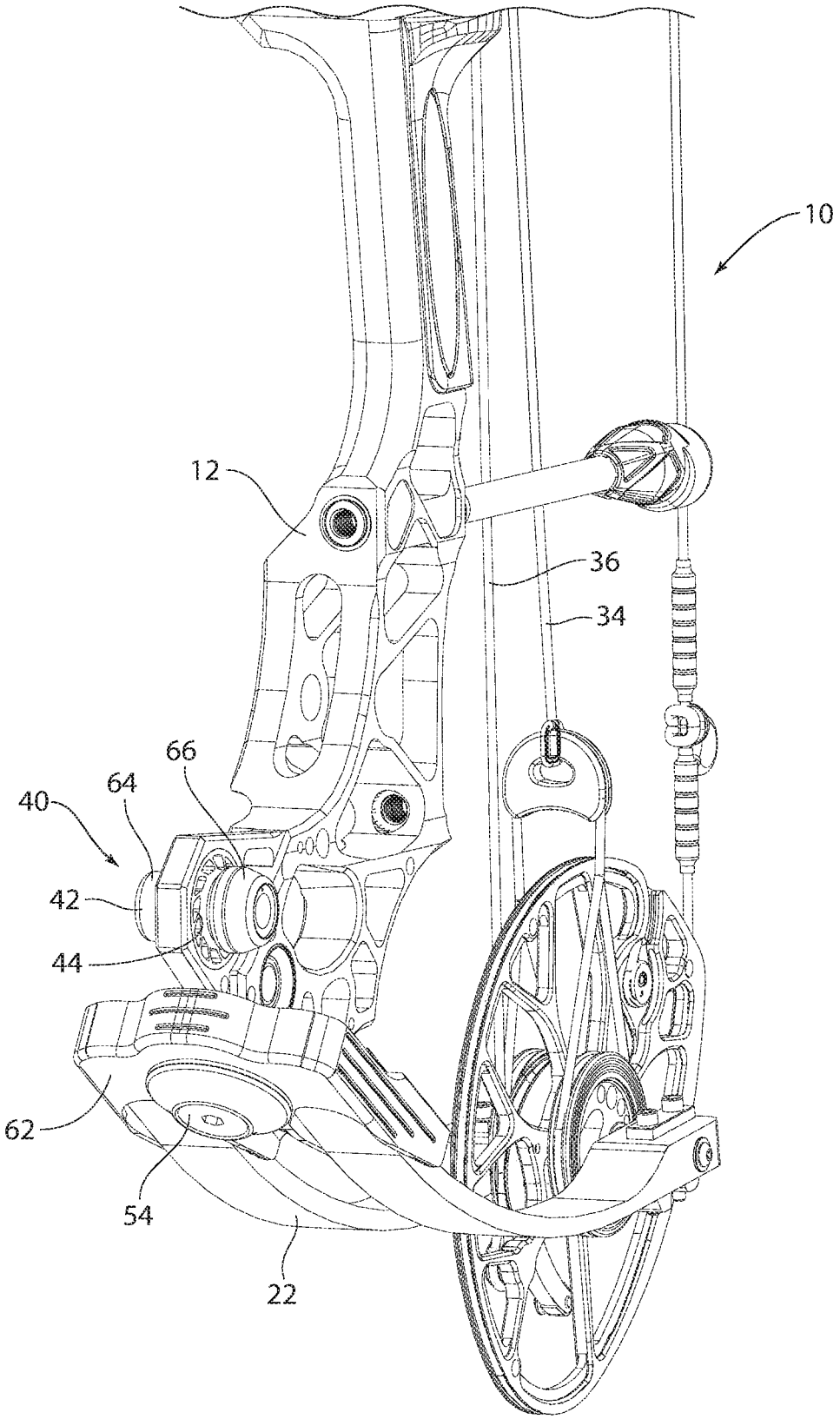
FIG. 7 shows another embodiment of a bow.
Figure 8:
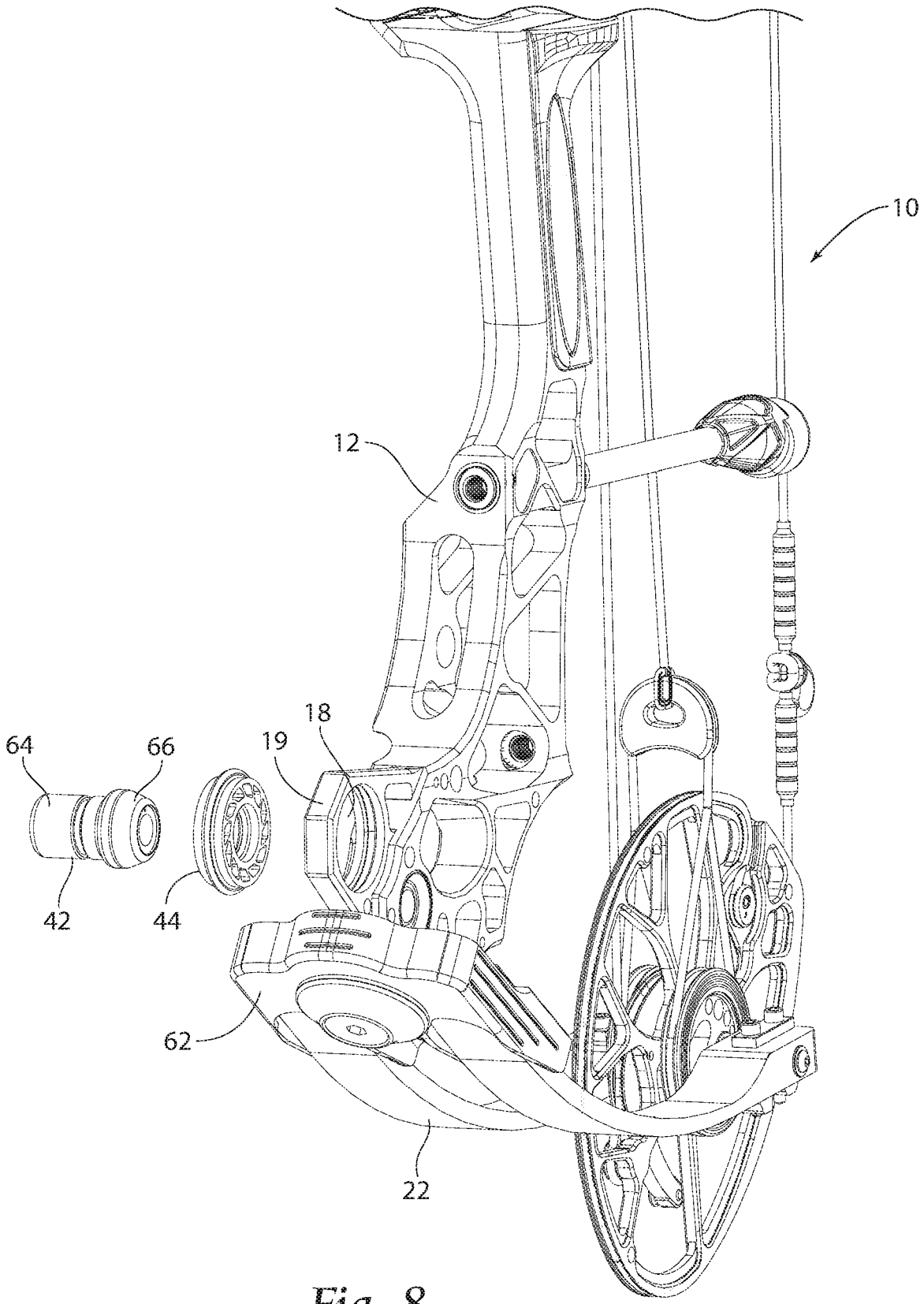
FIG. 8 shows an exploded view of the bow of FIG. 7.

FIG. 7 shows another embodiment of a bow 10, and FIG. 8 shows an exploded view of the bow 10. In some embodiments, the vibration damper 40 is asymmetric. In some embodiments, the weight 42 is asymmetric. In some embodiments, a first side 64 of the weight 42 has different characteristics than a second side 66 of the weight, for example comprising a different mass. In some embodiments, a first side 64 of the weight 42 is shaped differently from a second side 66. In some embodiments, the first side 64 and the second side 66 can have similar shapes, but the sides 64, 66 comprise different materials, for example having different densities. In some embodiments, the first side 64 and the second side 66 can have similar outer shapes but different internal constructions. In some embodiments, one side 64, 66 can comprise an internal cavity or bore to reduce mass. In some embodiments, a plug of higher density material can be used to increase mass. Any suitable arrangement for a weight 42 can be used.

In some embodiments, the bow 10 defines a bowstring plane, which comprises a theoretical plane that the bowstring 16 travels in. Desirably, the bowstring plane includes the shooting axis 11. In some embodiments, the damper 40 is centered on the bowstring plane. In some embodiments, the first side 64 is located to a first side of the bowstring plane and the second side 66 is located to a second side of the bowstring plane. In some embodiments, the cables 34, 36 are biased to a first side of the bowstring plane, for example by a cable guard. In some embodiments, the first side 64 of the weight 42 is smaller than the second side 66.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:
- a riser comprising a grip location;
- a first limb supported by the riser, the first limb attached by a first limb fastener, the first limb fastener engaging a first threaded cavity;
- a second limb supported by the riser, the second limb attached by a second limb fastener, the second limb fastener engaging a second threaded cavity;
- a bowstring;
- a vibration damper supported by the riser, the vibration damper comprising a resilient member and a weight, the resilient member comprising a central axis;
- a reference line extending through the first threaded cavity and the second threaded cavity;
- wherein the grip location and the central axis are located on opposite sides of the reference line.

2. The archery bow of claim 1, the vibration damper comprising a centroid, the grip location and the centroid located on opposite sides of the reference line.

3. The archery bow of claim 2, wherein the centroid is aligned upon the central axis.

4. The archery bow of claim 1, the bow defining a shooting axis, the resilient member central axis comprising a first central axis, the vibration damper comprising a central aperture defining a second central axis, the second central axis oriented orthogonal to the shooting axis.

5. The archery bow of claim 1, the bow defining a shooting axis, the riser comprising an aperture arranged to support the vibration damper, a central axis of the aperture oriented orthogonal to the shooting axis.

6. The archery bow of claim 1, the bow defining a shooting axis, the weight comprising a circular cross-sectional shape and defining a central axis, the central axis oriented orthogonal to the shooting axis.

7. The archery bow of claim 1, the grip location defining a pivot axis, wherein a reference line oriented parallel to the pivot axis intersects the vibration damper and the second limb fastener.

8. An archery bow comprising:
- a riser comprising a grip location;
- a first limb supported by the riser, the first limb attached by a first limb fastener, the first limb fastener engaging a first threaded cavity;
- a second limb supported by the riser, the second limb attached by a second limb fastener, the second limb fastener engaging a second threaded cavity;
- a bowstring;
- a vibration damper supported by the riser, the vibration damper comprising a resilient member and a weight, the vibration damper comprising a centroid;
- a reference line extending through the first threaded cavity and the second threaded cavity;
- wherein the grip location and the centroid are located on opposite sides of the reference line.

9. The archery bow of claim 8, the resilient member comprising a central axis, the grip location and the central axis located on opposite sides of the reference line.

10. The archery bow of claim 9, wherein the centroid is aligned upon the central axis.

11. The archery bow of claim 8, the bow defining a shooting axis, the vibration damper comprising a central aperture defining a central axis, the central axis oriented orthogonal to the shooting axis.

12. The archery bow of claim 8, the bow defining a shooting axis, the riser comprising an aperture arranged to support the vibration damper, a central axis of the aperture oriented orthogonal to the shooting axis.

13. The archery bow of claim 8, the bow defining a shooting axis, the weight comprising a circular cross-sectional shape and defining a central axis, the central axis oriented orthogonal to the shooting axis.

14. The archery bow of claim 8, the grip location defining a pivot axis, wherein a reference line oriented parallel to the pivot axis intersects the vibration damper and the second limb fastener.

15. An archery bow comprising:

a shooting axis;

a riser comprising a first portion oriented to a first side of the shooting axis and a second portion oriented to a second side of the shooting axis;

a first limb supported by the first portion of the riser, the first limb attached by a first limb fastener, the first limb fastener engaging a first threaded cavity;

a second limb supported by the second portion of the riser, the second limb attached by a second limb fastener, the second limb fastener engaging a second threaded cavity;

a bowstring;

the riser further comprising a vibration damper comprising a resilient member and a suspended weight, the vibration damper located on the second portion of the riser adjacent to the second limb fastener;

wherein the riser excludes any vibration damper on the first portion of the riser adjacent to the first limb fastener.

16. The archery bow of claim 15, the riser comprising a grip location defining a pivot axis, wherein a reference line oriented parallel to the pivot axis intersects the vibration damper and the second limb fastener.

17. The archery bow of claim 16, the resilient member comprising a central axis, wherein the grip location and the central axis are located on opposite sides of a reference line that extends through the first threaded cavity and the second threaded cavity.

18. The archery bow of claim 15, wherein the riser comprises a shape that is asymmetrical across the shooting axis.

19. The archery bow of claim 15, the resilient member comprising a central axis, the central axis oriented orthogonal to the shooting axis.

20. The archery bow of claim 15, the weight comprising a central axis, the central axis oriented orthogonal to the shooting axis.

* * * * *